US005090472A

United States Patent [19]

Uchida et al.

[11] Patent Number: 5,090,472

[45] Date of Patent: Feb. 25, 1992

[54] METHOD FOR VERTICALLY AND CONTINUOUSLY CASTING BERYLLIUM COPPER ALLOYS

[75] Inventors: Munenori Uchida, Handa, Japan; Donald A. Bates, Wyomissing, Pa.

[73] Assignees: NGK Insulators, Ltd., Aichi, Japan; NGK Metals Corporation, Temple, Pa.

[21] Appl. No.: 717,472

[22] Filed: Jun. 19, 1991

[51] Int. Cl.[5] ..... B22D 11/04

[52] U.S. Cl. ..... 164/489; 164/459; 164/487; 164/488

[58] Field of Search ..... 164/459, 487, 488, 489, 164/418, 437

[56] References Cited

U.S. PATENT DOCUMENTS

| | | | |
|---|---|---|---|
| 2,266,056 | 12/1941 | Martin | 148/12.7 C |
| 4,315,538 | 2/1982 | Nielsen | 164/488 |
| 4,394,185 | 7/1983 | McClelland et al. | 148/12.7 C X |
| 4,425,168 | 1/1984 | Goldstein et al. | 148/12.7 C X |

FOREIGN PATENT DOCUMENTS

| | | | |
|---|---|---|---|
| 58-119445 | 7/1983 | Japan | 164/487 |

OTHER PUBLICATIONS

*Beryllium Copper*, Issued by Copper Development Association, London, 1961, pp. 30–53.

*Primary Examiner*—J. Reed Batten, Jr.

*Attorney, Agent, or Firm*—Parkhurst, Wendel & Rossi

[57] ABSTRACT

A casting nozzle is first arranged in a melt of the beryllium copper alloy in a mold. This casting nozzle has a flow rate-regulating mechanism which is arranged in the melt in the mold and capable of regulating the flow rate of the melt to be poured into the mold. The nozzle is opened in the melt inside the mold. A melt is poured into the mold through the nozzle, and continuously cast in a casting temperature range from a liquidus temperature of the beryllium copper alloy to a temperature higher than the liquidus temperature by 50° C. Thereby, the beryllium copper alloy having a crystalline structure consisting essentially of isometric crystals can be obtained.

3 Claims, 4 Drawing Sheets

PRESENT INVENTION

METHOD FOR VERTICALLY AND CONTINUOUSLY CASTING BERYLLIUM COPPER ALLOYS

BACKGROUND OF THE INVENTION

1. Field of the Invention

The present invention relates to a method for vertically and continuously casting beryllium copper alloys. More particular, the invention relates to a method for vertically and continuously casting beryllium copper alloys having both excellent mechanical strength and excellent processability, in which a crystalline structure consists substantially of isometric crystals.

2. Related Art Statement

In conventional methods for vertically and continuously casting the beryllium copper alloys, in order to make the crystalline structure of the copper alloy finer, an agent for making crystals finer (hereinafter referred to as "crystal refiner") is used, a casting temperature is lowered, or a melt is stirred.

However, the crystal refiner poses contamination of the melt, and there is also a problem that no appropriate crystal refiner cannot be found depending upon an alloy composition.

Although decrease in the casting temperature has a merit that crystal nuclei formed are not dissolved into the melt again, it causes troubles such as clogging of a nozzle, and also poses problems from the standpoint of the quality that internal defects such as inclusion and residual pores are increased.

On the other hand, an electromagnetically stirring method has problems in that an installation cost is high, and internal defects such as inclusion, residual pores and the like are likely to increase from the standpoint of quality.

In order to continuously cast a beryllium copper alloy, for example, a casting apparatus as shown in FIGS. 1*a* and 1*b* is conventionally used.

In FIG. 1*a*, a reference numeral 1 is a tundish. A melt 2 inside the tundish 1 is poured into a mold 5 through a nozzle 3 fitted to a bottom of the tundish 1 and an opening 4 of the nozzle 3. A reference numeral 6 is a cast ingot extracted from the mold 5, and a reference numeral 7 is a cast ingot-extracting member for supporting the cast ingot 6 and leading it downwardly. A reference numeral 8 is a flow rate-regulating mechanism for the nozzle. This mechanism is located in the tundish, and regulates the flow rate of the melt to be poured into the mold 5 through the nozzle 3 by adjusting an opening degree of a melt introducing opening defined between an outer peripheral portion 8*a* of the regulating mechanism 8 at the lower end and a melt-introducing opening 3*a* of the nozzle 3. FIG. 1*b* is a sectional view of the nozzle in FIG. 1*a* along a Ib—Ib line.

The method for continuously casting the beryllium copper alloy by using this casting apparatus has the following problems.

That is, although the casting needs to be effected at low temperatures to obtain the isometric crystals, the low temperature casting is likely to cause clogging of nozzle 3. More particularly, even when the regulating mechanism 8 is opened in the initial stage of the casting, the static pressure of the melt 2 is not applied to the entire interior of the nozzle 3, and the flow amount of the melt through the nozzle 3 is small. Accordingly, the stream of the melt is likely to be cooled at the initial stage due to removal of heat through the nozzle 3, so that the nozzle 3 is likely to be clogged. On the other hand, if the casting temperature is elevated to prevent clogging of the nozzle, a temperature gradient between an outer shell portion and an interior portion of the melt poured into the mold 5 becomes greater. As a result, columnar crystals among the crystals of the beryllium copper alloy predominantly grow along the temperature gradient, so that the resulting crystal structure consists essentially of a columnar crystals and mechanical properties such as mechanical strength and processability are deteriorated.

Therefore, beryllium copper alloys having great mechanical strength and excellent processability in which the crystalline structure consists essentially of isometric crystals cannot be obtained by the conventional method for vertically and continuously casting the beryllium copper alloy.

SUMMARY OF THE INVENTION

It is therefore an object of the present invention to solve the above-mentioned problems, and to provide a method for vertically and continuously casting beryllium copper alloys having large mechanical strength and excellent processability, in which the crystalline structure consists essentially of the isometric crystals.

The above object can be accomplished by the method for vertically and continuously casting the beryllium copper alloy, characterized in that a casting nozzle having a flow rate-regulating mechanism, which is positioned in a melt inside a mold and can regulate a flow rate of the melt, and being opened in the melt inside the mold, is provided in the melt inside the mold, the melt is poured into the mold through the nozzle, and the beryllium copper alloy is vertically and continuously cast in a temperature range of a liquidus temperature of the beryllium copper alloy and a temperature higher than the liquidus temperature by 50° C., whereby the beryllium copper alloy having the crystalline structure consisting essentially of the isometric crystals can be obtained.

The present invention has been accomplished on the basis of the following knowledge.

That is, when the pouring rate of the melt is regulated at the upper end of the nozzle as shown in FIG. 1*a*, air enters the interior of the nozzle through a nozzle wall due to negative pressure generated inside the nozzle because the nozzle is made of porous carbon. Therefore, the melt falls down as a spiral flow in air inside the nozzle. When casting is effected at a low temperature to obtain the crystalline structure consisting of the isometric crystals, the temperature of the melt rapidly decreases and consequently the melt begins to be solidified so that the nozzle is likely to be clogged.

On the other hand, if the casting temperature is raised to prevent the clogging of the nozzle, the temperature gradient becomes greater as mentioned above, with the result that the crystalline structure is unfavorably converted to the columnar crystals having low mechanical strength and poor processability.

Since the present invention uses the casting nozzle having the melt flow rate-regulating mechanism to be located in the melt inside the mold, the static pressure of the melt inside a tundish is exerted uniformly over the entire inner peripheral surface of a flow path inside the nozzle. That is, since the static pressure of the melt is exerted over the entire nozzle, the flow amount of the melt in the initial stage of the casting is great. Consequently, the melt flows through the nozzle without being hindered due to the removal of heat of the melt through the nozzle, so that the melt flows down through the nozzle without clogging the nozzle. Accordingly, the melt flows down in a columnar fashion over the entire casting flow path of the nozzle. When the melt is continuously cast in the temperature range between the liquidus temperature of the beryllium copper alloy and the temperature higher than the liquidus temperature by 50° C. by using this casting nozzle, the beryllium copper alloy having excellent mechanical properties and processability can be obtained, in which the crystalline structure consists essentially of the isometric crystals. The present invention has been accomplished based on the above discovery.

According to the present invention, it is preferable that the melt of the beryllium copper alloy is continuously discharged into the mold over the substantially entire circumferential directions of the nozzle through the nozzle.

Further, according to the present invention, it is preferable that the flow rate of the melt of the beryllium copper alloy is regulated in the melt and at a lower end of the casting nozzle inside the mold.

The method for vertically and continuously casting the beryllium copper alloy according to the present invention is favorably applied to the beryllium copper alloys having the composition consisting essentially of 0.20–2.50% by weight of Be, 0.20–2.70% by weight of at least one element of Co, Ni and Al, and the balance being Cu and inevitable impurities.

A more preferable composition of the beryllium copper alloy is Cu-1.60–2.00 Be-0.20–0.35 Co, Cu-0.40–0.70 Be-2.40–2.70 Co, or Cu-0.20–0.60 Be-1.40–2.20 Ni.

Co has effects to prevent an intergranular phase reaction between Cu and Be and to make crystalline grains finder in a post treatment. When Co is 0.2–2.50% by weight, such conspicuous effects can be remarkably exhibited.

Co, Ni and Al has an effect to improve mechanical properties. If the content is less than 0.20% by weight, the mechanical properties cannot be largely improved. On the other hand, if it is more than 2.70% by weight, the improvement of the mechanical properties is saturated and electrical conductivity drops.

The reason why the casting temperature of the melt of the beryllium copper alloy is set in the temperature range of the liquidus temperature of the beryllium copper alloy to the temperature higher than the liquidus temperature by 50° C. is that if the casting temperature is less than the liquidus temperature, casting becomes impossible, whereas if it is higher than the liquidus temperature by more than 50° C., the crystalline structure consisting essentially of the isometric crystals cannot be obtained, and the columnar crystals having low mechanical strength and poor processability are produced.

The temperature range is preferably in a temperature range from the liquidus temperature to a temperature higher than the liquidus temperature by 10°–20° C.

The reason why the nozzle for continuously discharging the melt into the mold over the substantially entire circumferential directions is preferred as the casting nozzle for pouring the melt of the beryllium copper alloy into the mold is that the melt discharged has no directivity and the temperature gradient of the melt is small.

Further, the reason why the flow rate of the melt of the beryllium copper alloy is preferably regulated at the lower end of the casting nozzle located inside the mold is to prevent clogging of the nozzle and to reduce the temperature gradient.

In addition, if the content of Be in the composition of the beryllium copper alloy is less than 0.20% by weight, the intended mechanical properties of the beryllium copper alloy cannot be exhibited. On the other hand, if the content is more than 2.5% by weight, the degree of increasing the mechanical properties is small and this merely results in cost-up.

These and other objects, features and advantages of the invention will be appreciated upon reading of the following description of the invention when taken in conjunction with the attached drawings, with the understanding that some modifications, variations and changes of the same could be made by the skilled person in the art to which the invention pertains without departing from the spirit of the invention or the scope of claims appended hereto.

BRIEF DESCRIPTION OF THE DRAWINGS

For a better understanding of the invention, reference is made to the attached drawings, wherein.

DETAILED DESCRIPTION OF THE INVENTION

Now, the method for vertically and continuously casting the beryllium copper alloy according to the present invention will be explained in more detail below.

In the vertically and continuously casting method according to the present invention, it is necessary that the melt is poured into the mold through the nozzle having, in the melt inside the mold, the flow rate-regulating mechanism capable of regulating the flow rate of the melt to be poured into the mold as well as a discharge opening to discharge the melt into the mold.

Since the mechanism for regulating the flow rate of the melt to be poured into the mold is located in the melt inside the mold, the static pressure of the melt inside the tundish or the like is exerted upon the entire inner peripheral surface of the nozzle. Consequently, the melt flows down through the entire zone of the nozzle, and continuously fed into the mold through the discharge opening of the nozzle located in the melt inside the mold.

By way of example, as such a casting nozzle, a nozzle in which an opening degree of a discharge opening is adjusted by a float following the vertical displacement of the surface of the melt inside the mold is recited. However, any nozzle may be employed in the method according to the present invention so long as the nozzle allows the static pressure of the melt inside the tundish or the like to be exerted upon the inner peripheral surface of the nozzle. The skilled person will readily selectively employ such a nozzle.

In the vertically and continuously casting method according to the present invention, the melt needs to be continuously cast at the casting temperature from the liquidus temperature of the beryllium copper alloy and the temperature higher than this liquidus temperature by 50° C. The casting temperature used herein means the temperature of the melt in the tundish or the like to feed the melt into the mold. The casting temperature may be controlled to the above temperature range by setting the melting temperature of the alloy components to obtain the melt or by cooling the melt after the melting step.

The present invention will be further explained with referenced to the drawings.

Figure 1A:
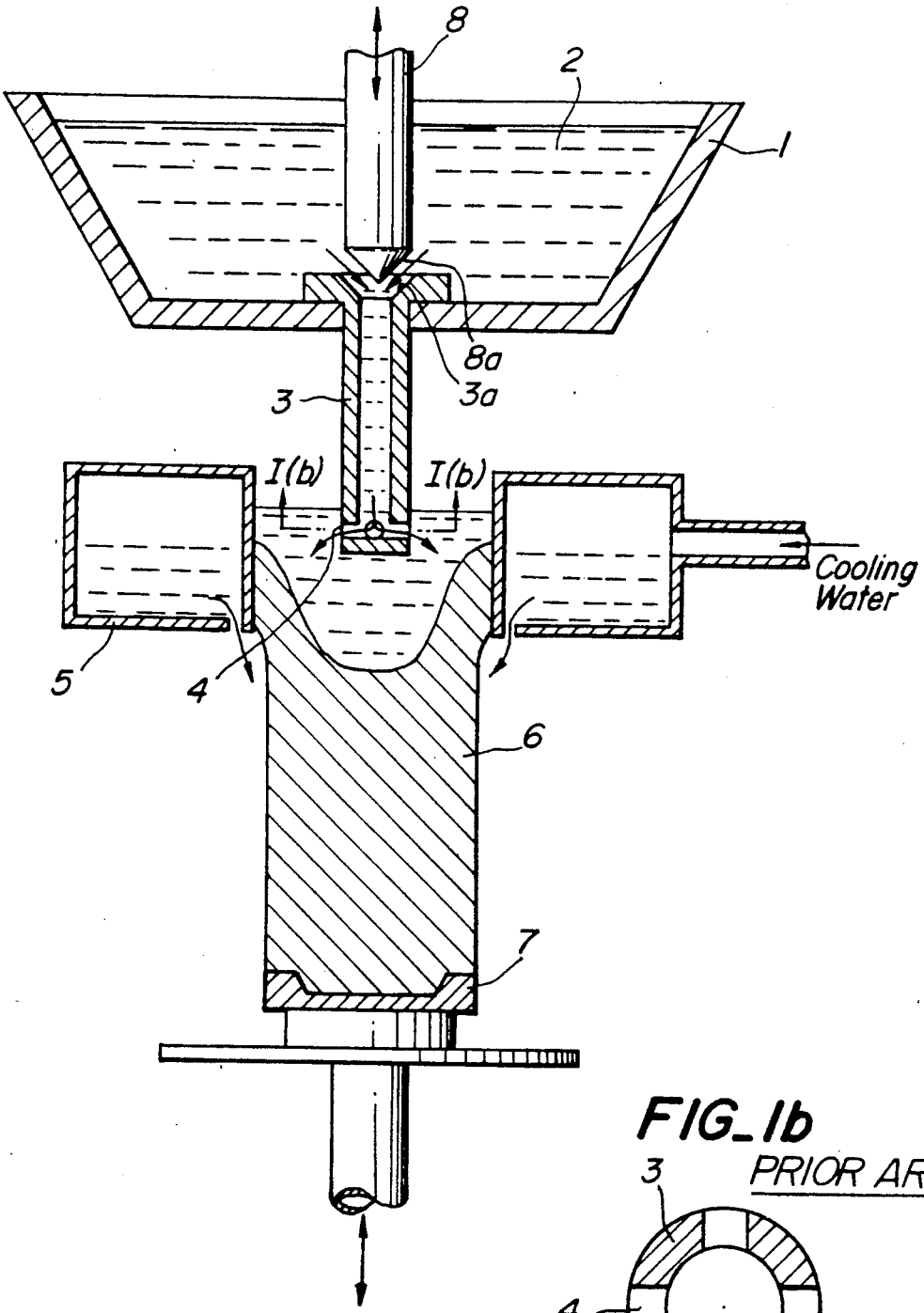
FIG 1a PRIOR ART
FIG. 1*a* is a vertical sectional view of the vertical type continuously casting apparatus to be used in the conventional method for vertically and continuously casting the beryllium copper alloy.
Figure 1B:
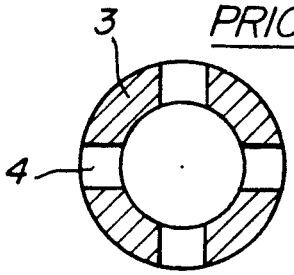
FIG 1b PRIOR ART
FIG. 1*b* is a sectional view of the casting nozzle of the apparatus in FIG. 1*a* taken along a line Ib—Ib.
Figure 2A:
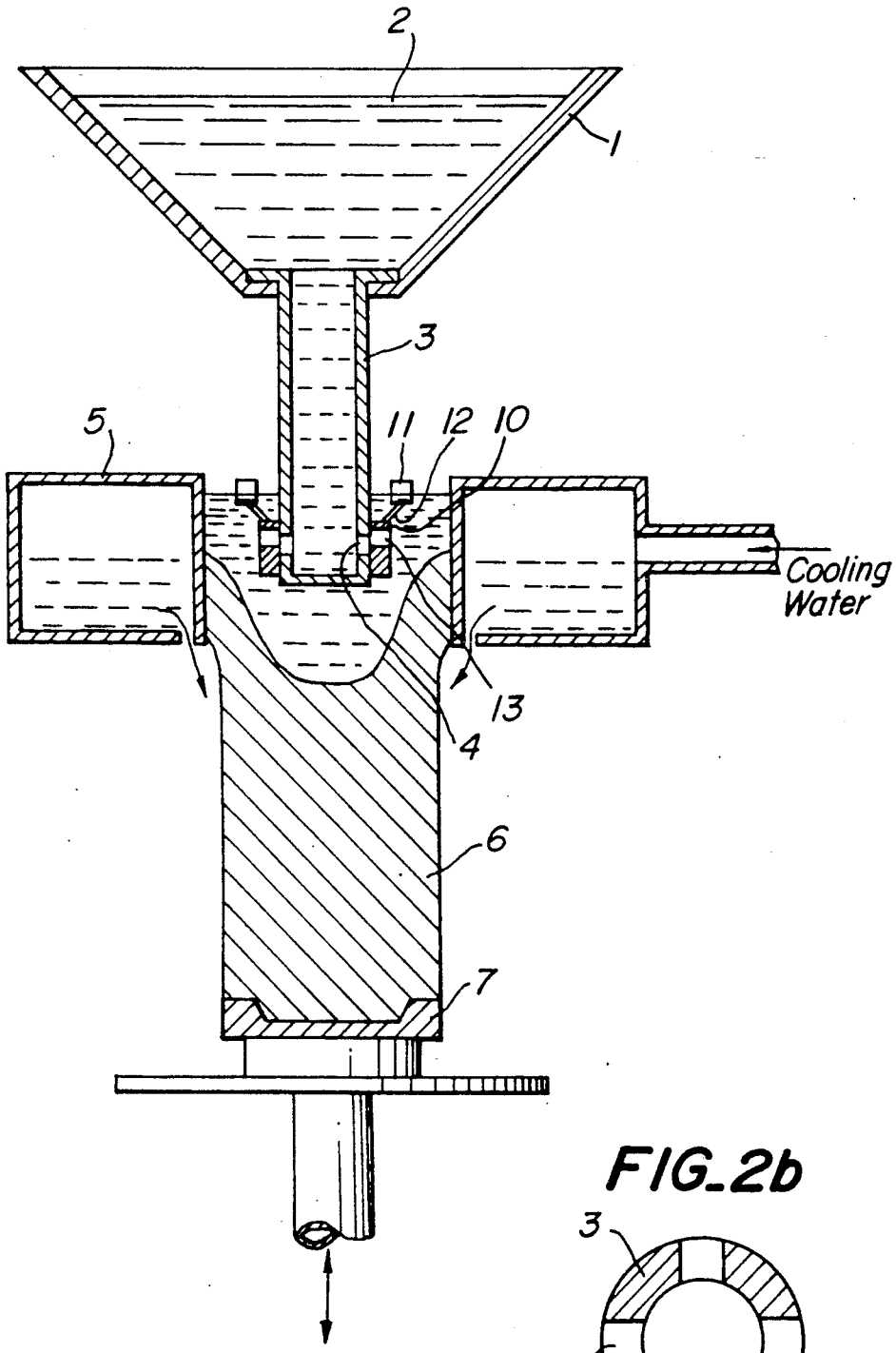
FIG. 2*a* is a vertical sectional view of a vertical type continuously casting apparatus to be used in the method for vertically and continuously casting the beryllium copper alloy according to the present invention.
Figure 2B:
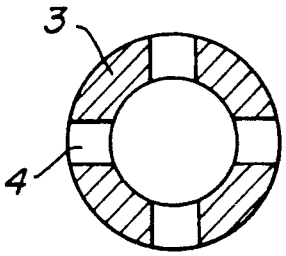
FIG. 2*b* is a sectional view of the casting nozzle of the apparatus in FIG. 2*a*.

FIGS. 2*a* and 2*b* illustrate an embodiment of the vertical type continuous casting apparatus for performing the method for vertically and continuously casting the beryllium copper alloy according to the present invention. In these figures, the same reference numerals as in FIGS. 1*a* and 1*b* denote same or similar constituent parts as in FIGS. 1*a* and 1*b*, respectively, and explanation thereof is therefore omitted.

A nozzle 3, which pours a melt 2 inside a tundish 1 into a mold 5, is closed at a lower end, and as shown in FIG. 2*b*, discharge openings 4 are opened in a crossed arrangement in a peripheral wall of the nozzle 3 at a location spaced slightly upwardly from the lower end by a given distance. A flow rate-regulating ring 10 is slidably provided around the outer periphery of the lower side wall of the nozzle, and is connected to an annular float 11 floating on a surface of the melt inside the mold by means of an appropriate number of connecting members 12. The ring 10 is provided with flow rate-regulating openings 13 in a crossed fashion in the same radial directions as in the discharge openings 4 of the nozzle 3. When the float 11 is vertically displaced following vertical movement of the surface of the melt inside the mold, overlapping portions between the discharge openings 4 of the nozzle 3 and the flow rate-regulating openings 13 of the ring 10 vary so that the flow rate of the melt to be poured into the mold may be regulated. At that time, the melt flow rate-regulating mechanism is constituted by the ring 10, the float 11, the discharge openings 4 and the flow rate-regulating openings 13. Since the flow rate of the melt is regulated in the melt inside the mold, the static pressure of the melt inside the tundish 1 is uniformly exerted upon the entire inner peripheral surface of the nozzle 3. As a result, the melt flows down through the nozzle over the entire horizontal area of the nozzle. Therefore, when the melt is continuously cast in the casting temperature range from the liquidus temperature of the beryllium copper alloy to the temperature higher than the liquidus temperature by 50° C., no great temperature gradient occurs in the melt. Consequently, the beryllium copper alloy in which the crystalline structure consists substantially of the isometric crystals can be obtained.

In the embodiment shown in FIGS. 2*a* and 2*b*, the discharge openings 4 are provided in the crossed fashion in the lower portion of the peripheral wall of the nozzle 3. Instead, discharge openings may be provided in the peripheral wall of the nozzle at the lower end. Further, the nozzle may be constituted by a nozzle body and a separate lower nozzle end portion such that a discharge opening is defined between the nozzle body and the lower nozzle end portion, extending through the peripheral wall of the nozzle in an entirely circumferential direction. In this case, the float may be connected to the lower nozzle end portion by means of the connecting means 12. As to such a nozzle, since the melt is continuously discharged into the mold through the discharge opening in the substantially entire circumferential direction, it can be expected that the temperature gradient is further decreased.

Next, another and preferable embodiment of the vertical type continuously casting apparatus for performing the vertically and continuous casting method according to the present invention will be explained with reference to FIG. 3.

The same reference numerals as in FIGS. 1*a* and 1*b* denote the same or similar constituent parts as in FIGS. 1*a* and 1*b*, respectively, and therefore explanation thereof will be omitted.

Figure 3:
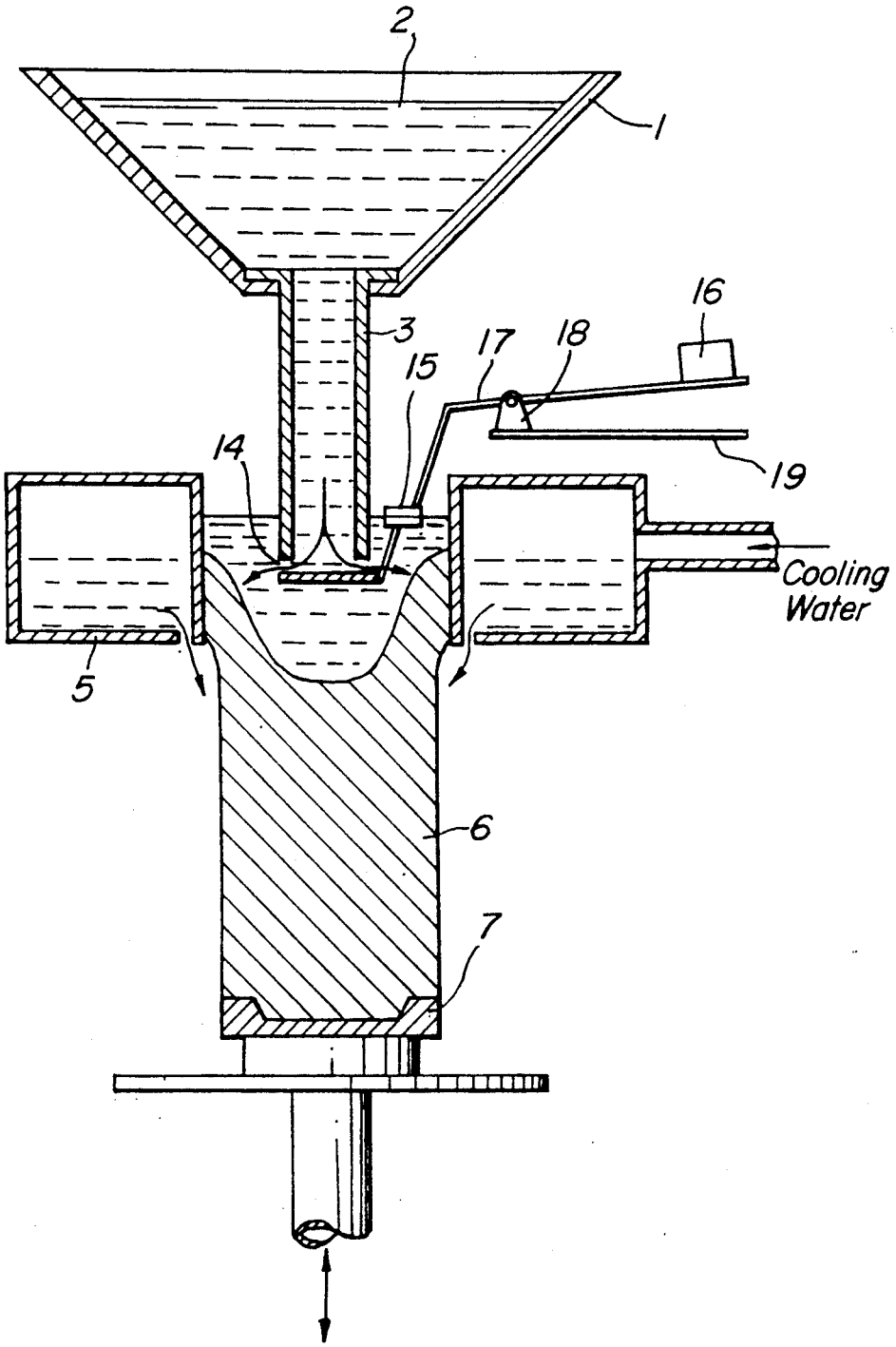
FIG. 3 is a vertical sectional view of another vertical type continuously casting apparatus to be used in the method for vertically and continuously casting the beryllium copper alloy according to the present invention.

In FIG. 3, a planar valve 14 is arranged under an opening of a nozzle at a lower end, and a discharge opening 4, which is opened over an entire circumferential direction, is defined by an end of the opening of the nozzle 3 and the planar valve 14. One end of a swingable arm 17 is fixed to the valve 14 at a appropriate location on its peripheral side surface, and a weight 16 is attached to the other end of the arm 17. The arm 17 is swingably supported on a bearing 18 placed on one end portion of a cantilever 19. A float 11 is fitted to the arm 17 at a given location so that the float 11 may be floated on the surface of the melt inside the mold 5. The melt flow rate-regulating mechanism is constituted by the planar valve 14, the swingable arm 17, the weight 16, the cantilever 19, the bearing 18 and the float 11. When the surface of the melt inside the mold vertically moves, the arm 17 is accordingly swung around the bearing 18. As a result, the valve 14 is vertically displaced, the opening degree of the discharge opening 14 defined between the end of the opening of the nozzle 3 and the valve 14 is changed. Thus, the height of the melt inside the mold is automatically controlled.

As illustrated, since the discharge opening 4 of the nozzle 3 is defined between the substantially horizontal end surface of the opening of the nozzle 3 and the surface of the planar valve 14, the melt is discharged substantially horizontally into the mold through the entire peripheral portion of the nozzle.

It is preferable to make the clearance between the nozzle 3 and the valve 14 smaller. For, the smaller this clearance, the greater can the flow rate of the melt be made. Therefore, since the melt vigorously impinges upon the wall of the mold, it can strongly stir the melt in the mold to make the crystals finer.

In the following, the present invention will be explained more concretely with reference to specific examples.

EXAMPLES AND COMPARATIVE EXAMPLES

A melt of a beryllium copper alloy having a composition shown in the following table was prepared, and was vertically and continuously cast in a rod-like shape having a diameter of 200 mm under casting conditions shown in this table. Castability, percentages of isometric crystals and mechanical properties of resulting cast ingots are also given in the table.

TABLE 1

| | | Chemical composition of Be—Cu alloy | | | | Liquidus temperature (°C.) | Casting conditions: Producing apparatus | Casting conditions: Casting temperature (°C.) | Heat treatment conditions: Solution treatment | Heat treatment conditions: Aging | Castability | Percentage of isometric crystals (%) | Mechanical properties: Tensile strength (kg/mm²) | Mechanical properties: Elongation (%) |
|---|---|---|---|---|---|---|---|---|---|---|---|---|---|---|
| | | Be | Co | Ni | Al | | | | | | | | | |
| 1 | 1-1 | 0.31 | — | 1.95 | — | 1,070 | FIG. 2 | 1,116 | 920° C. × 3 h | 450° C. × 3 h | good | 100 | 75.8 | 10.0 |
| | 1-2 | " | " | " | " | " | FIG. 2 | 1,089 | " | " | good | 100 | 77.3 | 11.5 |
| | 1-3 | " | " | " | " | " | FIG. 3 | 1,118 | " | " | good | 100 | 76.2 | 11.1 |
| | 1-4 | " | " | " | " | " | FIG. 3 | 1,087 | " | " | good | 100 | 79.1 | 12.7 |
| | 1-5 | " | " | " | " | " | FIG. 1 | 1,142 | " | " | good | 13 | 70.3 | 6.1 |
| | 1-6 | " | " | " | " | " | FIG. 1 | 1,113 | " | " | no good | — | — | — |
| 2 | 2-1 | 0.36 | — | 1.85 | 0.8 | 1,063 | FIG. 2 | 1,110 | 920° C. × 3 h | 450° C. × 3 h | good | 100 | 76.3 | 9.8 |
| | 2-2 | " | " | " | " | " | FIG. 2 | 1,082 | " | " | good | 100 | 79.8 | 11.2 |
| | 2-3 | " | " | " | " | " | FIG. 3 | 1,108 | " | " | good | 100 | 78.4 | 10.9 |
| | 2-4 | " | " | " | " | " | FIG. 3 | 1,081 | " | " | good | 100 | 80.9 | 13.1 |
| | 2-5 | " | " | " | " | " | FIG. 1 | 1,132 | " | " | good | 28 | 74.3 | 6.5 |
| | 2-6 | " | " | " | " | " | FIG. 1 | 1,110 | " | " | no good | — | — | — |
| 3 | 3-1 | 0.45 | 2.53 | — | — | 1,068 | FIG. 2 | 1,101 | 920° C. × 3 h | 450° C. × 3 h | good | 100 | 71.2 | 10.0 |
| | 3-2 | " | " | " | " | " | FIG. 2 | 1,083 | " | " | good | 100 | 74.3 | 12.1 |
| | 3-3 | " | " | " | " | " | FIG. 3 | 1,099 | " | " | good | 100 | 73.7 | 12.2 |
| | 3-4 | " | " | " | " | " | FIG. 3 | 1,080 | " | " | good | 100 | 76.2 | 14.4 |
| | 3-5 | " | " | " | " | " | FIG. 1 | 1,134 | " | " | good | 8 | 69.8 | 5.8 |
| | 3-6 | " | " | " | " | " | FIG. 1 | 1,098 | " | " | no good | — | — | — |
| 4 | 4-1 | 1.02 | — | 1.13 | 1.8 | 1,003 | FIG. 2 | 1,032 | 820° C. × 3 h | 340° C. × 2.5 h | good | 100 | 90.8 | 4.8 |
| | 4-2 | " | " | " | " | " | FIG. 2 | 1,018 | " | 340° C. × 2.5 h | good | 100 | 92.3 | 6.0 |
| | 4-3 | " | " | " | " | " | FIG. 3 | 1,049 | " | 340° C. × 2.5 h | good | 100 | 92.1 | 6.9 |
| | 4-4 | " | " | " | " | " | FIG. 3 | 1,021 | " | 340° C. × 2.5 h | good | 100 | 94.3 | 8.4 |
| | 4-5 | " | " | " | " | " | FIG. 1 | 1,100 | " | 340° C. × 2.5 h | good | 24 | 86.5 | 3.5 |
| | 4-6 | " | " | " | " | " | FIG. 1 | 1,047 | " | 340° C. × 2.5 h | no good | — | — | — |
| 5 | 5-1 | 1.63 | 0.25 | — | — | 991 | FIG. 2 | 1,041 | 800° C. × 3 h | 320° C. × 3 h | good | 100 | 105.2 | 5.2 |
| | 5-2 | " | " | " | " | " | FIG. 2 | 1,010 | " | " | good | 100 | 107.8 | 6.8 |
| | 5-3 | " | " | " | " | " | FIG. 3 | 1,037 | " | " | good | 100 | 108.6 | 6.5 |
| | 5-4 | " | " | " | " | " | FIG. 3 | 1,010 | " | " | good | 100 | 110.2 | 7.6 |
| | 5-5 | " | " | " | " | " | FIG. 1 | 1,098 | " | " | good | 38 | 98.6 | 1.3 |
| | 5-6 | " | " | " | " | " | FIG. 1 | 1,038 | " | " | no good | — | — | — |
| 6 | 6-1 | 1.89 | 0.22 | — | — | 972 | FIG. 2 | 1,020 | 800° C. × 3 h | 320° C. × 3 h | good | 100 | 113.2 | 6.0 |
| | 6-2 | " | " | " | " | " | FIG. 2 | 988 | " | " | good | 100 | 115.4 | 7.7 |
| | 6-3 | " | " | " | " | " | FIG. 3 | 1,013 | " | " | good | 100 | 115.2 | 6.4 |
| | 6-4 | " | " | " | " | " | FIG. 3 | 990 | " | " | good | 100 | 118.3 | 8.2 |
| | 6-5 | " | " | " | " | " | FIG. 1 | 1,082 | " | " | good | 43 | 100.7 | 1.0 |
| | 6-6 | " | " | " | " | " | FIG. 1 | 1,011 | " | " | no good | — | — | — |
| 7 | 7-1 | 2.01 | 0.26 | — | — | 964 | FIG. 2 | 1,000 | 800° C. × 3 h | 320° C. × 3 h | good | 100 | 113.8 | 5.1 |
| | 7-2 | " | " | " | " | " | FIG. 2 | 980 | " | " | good | 100 | 116.2 | 6.8 |
| | 7-3 | " | " | " | " | " | FIG. 3 | 1,004 | " | " | good | 100 | 116.1 | 5.8 |
| | 7-4 | " | " | " | " | " | FIG. 3 | 982 | " | " | good | 100 | 120.1 | 7.3 |
| | 7-5 | " | " | " | " | " | FIG. 1 | 1,072 | " | " | good | 42 | 100.6 | 1.2 |
| | 7-6 | " | " | " | " | " | FIG. 1 | 990 | " | " | no good | — | — | — |

In the above table, "good" and "no good" denote a case where the continuous casting was effected with no clogging of the nozzle and a case where the continuous casting was impossible due to clogging of the nozzle, respectively The percentage of the isometric crystals was determined by subjecting a rod-shaped cast ingot having a diameter of 200 mm to a solution treatment and an aging treatment under conditions given in the table, cutting out a cast mass, etching a cut surface of the cast mass with nitric acid, and obtaining an area ratio between isometric crystals and columnar crystals through visually observing a macro-structure.

It is seen from the above table that according to the continuous casting method using the conventional vertically casting apparatus in FIG. 1, when the continuous casting was effected in the state that the casting temperature was set higher to prevent clogging of the nozzle, the percentage of the isometric crystals was small so that the mechanical properties such as tensile strength and elongation became poorer. On the other hand, when the casting temperature was lowered in the conventional vertically casting method to increase the percentage of the isometric crystals, the nozzle was clogged to make the continuous casting impossible.

To the contrary, it is seen that according to the present invention, the percentage of the isometric crystals is 100% by weight, and the beryllium copper alloy having excellent mechanical properties such as tensile strength and elongation can be obtained. It is further seen that as compared with the employment of the apparatus in FIGS. 2*a* and 2*b*, when the apparatus shown in FIG. 3 in which the melt is discharged into the mold through the nozzle over the substantially entire circumferential direction was used, the beryllium copper alloy having more excellent mechanical properties can be obtained. Moreover, when the casting is effected at the temperature higher than the liquidus temperature by 10°–20° C., the beryllium copper alloy having most excellent mechanical properties can be obtained.

Figure 4A:
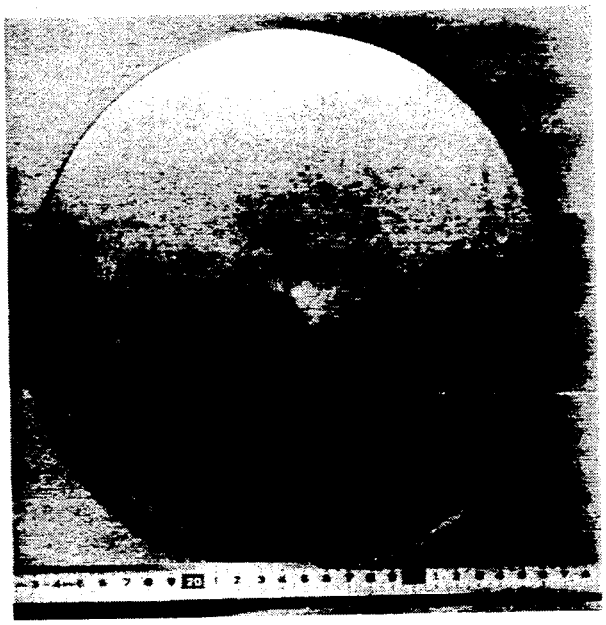
FIGS. 4*a* and 4*b* are macro-structure photographs of cross sectional surfaces of beryllium copper alloys continuously cast by the method of the present invention and the conventional method, respectively.
Figure 4B:
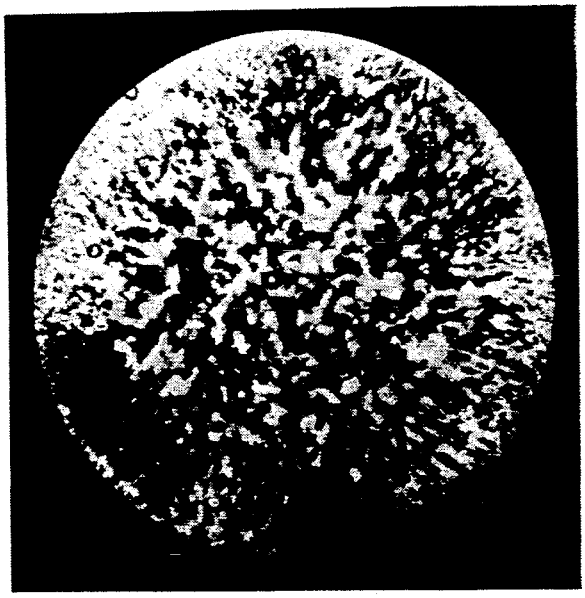
FIG 4b PRIOR ART

In order to examine the crystalline structure of the beryllium copper alloys continuously cast, after a cut surface of the cast mass in each of Run Nos. 6-4 (Present invention) and 6-5 (Conventional example) was etched with nitric acid, the microscopic crystalline structure of the cast mass was visually observed. FIGS. 4*a* and 4*b* are photographs of the macro-structures of Run Nos. 6-4 and 6-5, respectively. As seen from these photographs, fine isometric crystals are precipitated over the entire surface in the product according to the present invention, whereas the columnar crystals are precipitated over a wide area in the conventional product.

What is claimed is:

1. A method for vertically and continuously casting a beryllium copper alloy having a crystalline structure consisting essentially of isometric crystals, comprising the steps of arranging a casting nozzle in a melt of the beryllium copper alloy in a mold, said casting nozzle having a flow rate-regulating mechanism which is located in the melt in the mold for regulating the flow rate of the melt to be poured into the mold, said nozzle being opened in the melt inside the mold, pouring the melt into the mold through the nozzle, and continuously casting the beryllium copper alloy in a casting temperature range from the liquidus temperature of the beryllium copper alloy to a temperature higher than the liquidus temperature by 50° C., whereby the beryllium copper alloy having a crystalline structure consisting essentially of isometric crystals is obtained.

2. The method according to claim 1, wherein the melt of the beryllium copper alloy is continuously discharged into the mold through the casting nozzle over the substantially entire circumferential direction.

3. The method according to claim 1, wherein the composition of the beryllium copper alloy is 0.202.50% by weight of Be, 0.20–2.70% by weight of at least one element selected from Co, Ni and Al, and the balance being Cu and inevitable impurities.

* * * * *